US005568913A

United States Patent [19]

Nagler

[11] Patent Number: 5,568,913

[45] Date of Patent: Oct. 29, 1996

[54] IMPACT ABSORBING DEVICE

[76] Inventor: Yaacov Nagler, 7300 Pyle Rd., Bethesda, Md. 20817

[21] Appl. No.: 442,504

[22] Filed: May 16, 1995

[51] Int. Cl.[6] ..... E01F 15/00

[52] U.S. Cl. ..... 256/13.1; 404/6

[58] Field of Search ..... 256/13.1; 404/6, 404/9, 10

[56] References Cited

U.S. PATENT DOCUMENTS

| | | | |
|---|---|---|---|
| 3,661,359 | 5/1972 | Walker . | |
| 3,674,115 | 7/1972 | Young et al. . | |
| 3,776,520 | 12/1973 | Charles et al. | 256/13.1 |
| 3,951,384 | 4/1976 | Hildreth . | |
| 4,057,141 | 11/1977 | Laurie et al. . | |
| 4,288,061 | 9/1981 | Moreau | 256/13.1 X |
| 5,056,961 | 10/1991 | McMeans et al. . | |
| 5,199,813 | 4/1993 | Nagler . | |
| 5,229,183 | 7/1993 | Eastman . | |
| 5,238,228 | 8/1993 | Moon | 256/13.1 |
| 5,316,815 | 5/1994 | Tripp | 404/6 X |

FOREIGN PATENT DOCUMENTS

| | | | |
|---|---|---|---|
| 2460365 | 2/1981 | France | 256/13.1 |
| 618488 | 7/1980 | Switzerland | 256/13.1 |
| 975871 | 11/1982 | U.S.S.R. | 256/13.1 |

*Primary Examiner*—Anthony Knight
*Attorney, Agent, or Firm*—Brady, O'Boyle & Gates

[57] ABSTRACT

An impact absorbing device includes a plurality of nested annular tread portions of discarded tires. The nested tread portions are constructed and arranged to be positioned at the end of a guard rail or wall to provide an impact absorbing abutment, or to form a wall or fence, or to be inserted into conventional road abutment containers.

8 Claims, 2 Drawing Sheets

FIG. 1
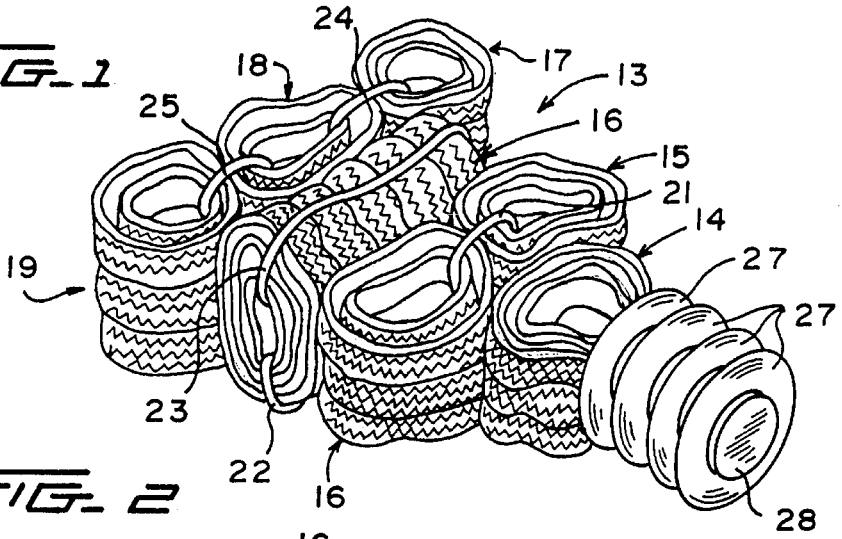
FIG. 2
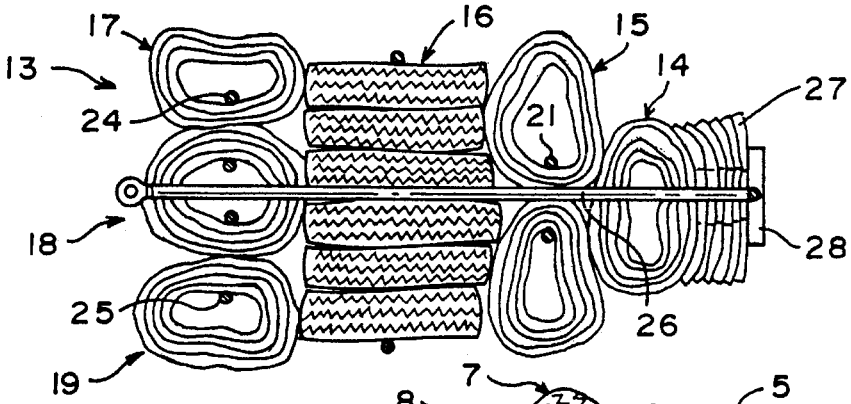
FIG. 3
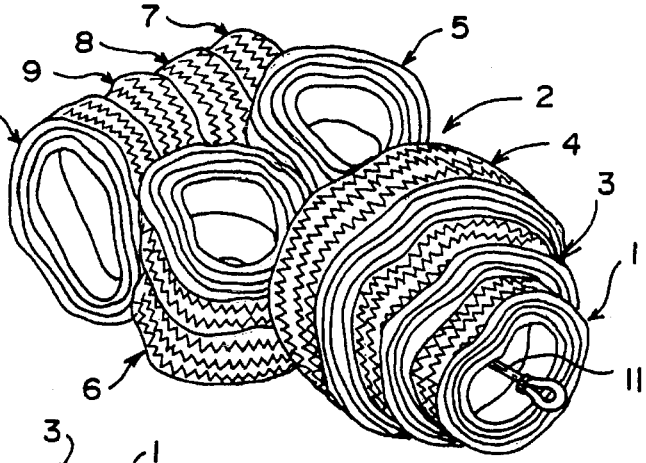
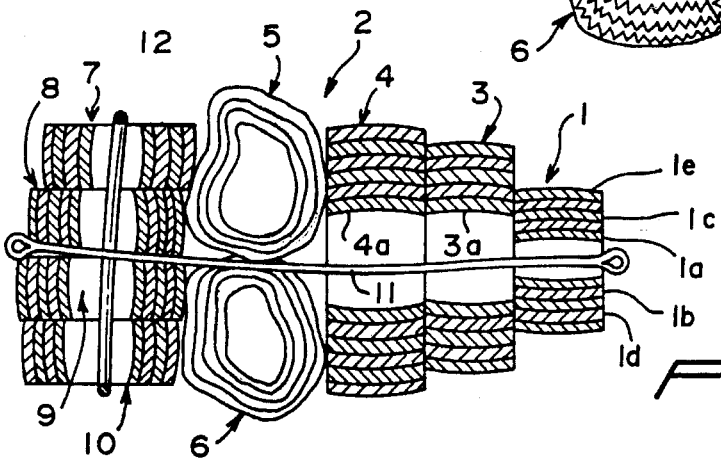
FIG. 4

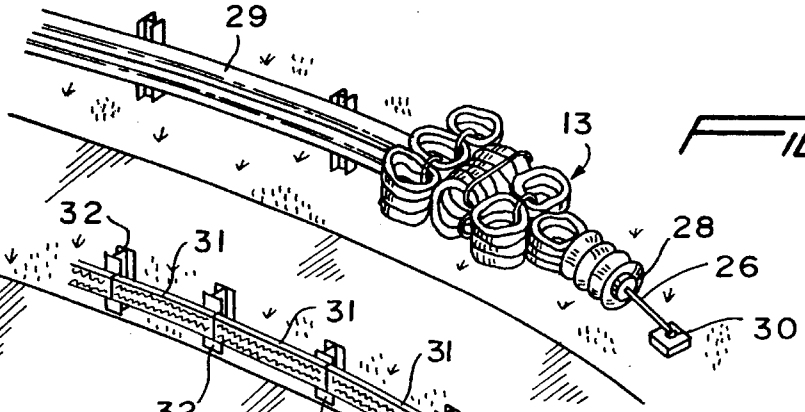
FIG. 5
FIG. 8
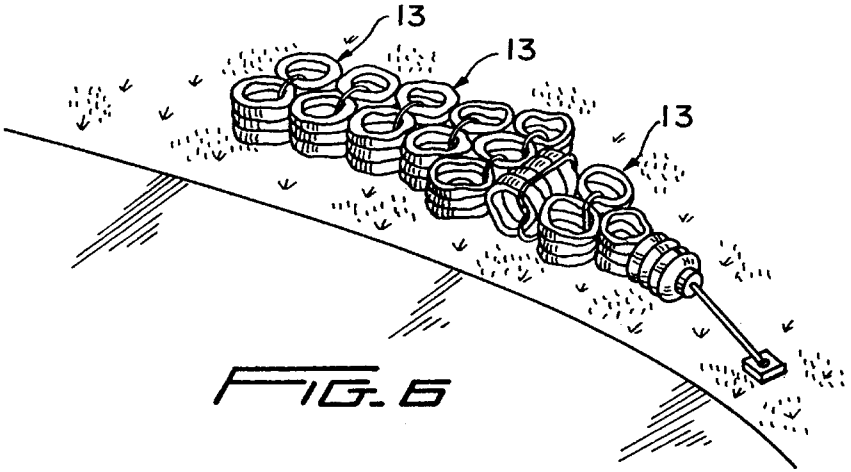
FIG. 6
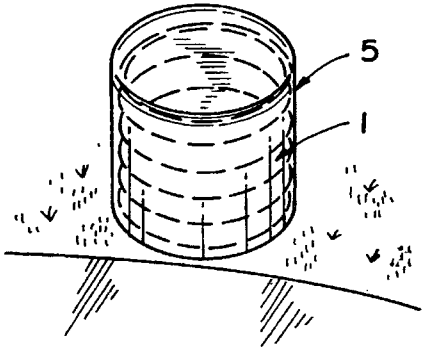
FIG. 7

IMPACT ABSORBING DEVICE

BACKGROUND OF THE INVENTION

In applicant's U.S. Pat. Nos. 5,199,813 dated Apr. 6, 1993, there is disclosed a road marker weight having a plurality of stacked sidewalls of discarded vehicle tires. In his continuing research and experimentation to find new uses for old or worn out vehicle tires, and, more particularly, to find a use for the tread portion of the tires from which the above-noted sidewalls had been cut, the impact absorbing device of the present invention has been devised.

SUMMARY OF THE INVENTION

The impact absorbing device of the present invention comprises, essentially, a plurality of nested annular tread portions of discarded vehicle tires. The tread portions are of various diameters with the innermost tread portion having the smallest diameter, with each successive annular tread portion having a greater diameter than the next preceding tread portion to thereby provide a unit having a plurality of coaxial annular tread portions.

The unit can be inserted into a road abutment consisting of a conventional plastic cylinder container, in lieu of the sand usually contained therein, whereby the resilience of the unit absorbs an impact from a vehicle more readily than a volume of sand.

A plurality of units can be connected together in various arrangements and connected between the end of a guard rail or wall and the ground to form an impact absorbing device, or a plurality of the impact absorbing devices can be connected together to form a guard rail or wall.

BRIEF DESCRIPTION OF THE DRAWINGS

FIG. 1 is a perspective view of one embodiment of the impact absorbing device of the present invention;

FIG. 2 is a top plan view, partly in section, of the embodiment shown in FIG. 1;

FIG. 3 is a perspective view of another embodiment of the impact device of the present invention;

FIG. 4 is a top plan view, partly in section, of the embodiment shown in FIG. 3;

FIG. 5 is a perspective view showing the embodiment of FIG. 1 mounted at the end of a guard rail and anchored to the ground;

FIG. 6 is a perspective view showing the embodiment of FIG. 1 interconnected to form a guard rail or wall;

FIG. 7 is a perspective view showing a unit of the impact device of the present invention contained in a plastic road abutment; and FIG. 8 is a perspective view of an impact absorbing rail employing tire tread portions.

DESCRIPTION OF THE PREFERRED EMBODIMENTS

Referring to the drawings and, more particularly, to FIGS. 3 and 4, the basic unit 1 employed in the impact absorbing device 2 of the present invention comprises a plurality of nested tire tread portions 1*a*, 1*b*, 1*c*, 1*d*, and 1*e* arranged coaxially with respect to each other with the innermost tread portion 1*a* having the smallest diameter, with each succeeding tread portion 1*b*, 1*c*, 1*d*, and 1*e* having a greater diameter than the next preceding tread portion. The total diameter of a respective units such as 3 and 4 is determined by the diameter of the innermost tread portions 3*a* and 4*a*. The annular tread portions 1*a* through 1*e* are held in nested relationship by the frictional fit between the outer surface on one tread portion engaging the inner surface of the adjacent annular tread portion.

FIG. 7 illustrates one use of the unit 1 wherein, in lieu of sand filling a conventional cylindrical plastic container 5 employed as a road abutment, a plurality of units 1 are contained in the container 5, whereby an impact from a vehicle is more readily absorbed.

Returning to FIGS. 3 and 4, the units 1, 3, and 4 are axially aligned in abutting relationship; additional units 5 and 6 are arranged in side-by-side relationship with their longitudinal axes extending vertically transverse to the longitudinal axes of units 1, 3, and 4, and still additional units 7, 8, 9, and 10 are axially aligned, in abutting relationship, with their longitudinal axes extending transversely to the axes of units 1, 3, 4, 5, and 6. The units are held in assembled relationship by suitable cables 11 and 12 to thereby provide the impact device 2.

FIGS. 1 and 2 illustrate another embodiment of a plurality of interconnected units providing an impact device 13. While unit 14 is similar to units 1, and 3 through 10 shown in FIGS. 3 and 4, the remaining units 15 through 19 comprise a plurality of nested tire tread portions arranged coaxially, one within the other; however, there is no frictional engagement between adjacent tread portions, as in the embodiment of FIGS. 3 and 4, but rather, suitable cables 21, 22, 23, 24, and 25 are employed to not only hold the tire tread portions in assembled, nested relationship, but also to hold adjacent units together. The units 14, 15, and 16 are arranged in side-by-side relationship with their longitudinal axes extending vertically. The longitudinal axis of unit 16 extends horizontally, and the units 17, 18, and 19 are arranged in side-by-side relationship with their longitudinal axes extending vertically. All of the units are secured together to provide the impact device 13 by a tie rod 26 extending through the tire tread portions of units 14 and 18 and between the tire tread portions of units 15 and 16. The end of the tire rod 26 adjacent the unit 14 extends through a plurality of discarded tire sidewalls 27 which are held against the unit 14 by a flange 28 on the end of the tie rod 26.

FIG. 5 illustrates one of the environments in which the impact device 13 is adapted to be used; namely, as an impact abutment positioned at the end of a guard rail 29, wherein one end of the tie rod 26 is secured to the guard rail and the opposite end of the tie rod 26 extends through the flange 28 and anchored to the ground as at 30.

FIG. 6 illustrates another arrangement wherein a plurality of impact devices 13 are connected end-to-end to provide an impact absorbing retaining wall.

While impact device 13 has been described for use in the environments of FIGS. 5 and 6, it will be understood that the impact device 2 shown in FIGS. 3 and 5 can also be similarly installed to provide a guard rail abutment or a retaining wall. Furthermore, as shown in FIG. 8, a plurality of strips of tire tread portions 31 can be connected between stanchions 32 on either one or both sides thereof to provide an impact absorbing rail.

From the above description, it will be appreciated by those skilled in the art that applicant has provided a more complete use of discarded tires by employing the sidewalls as a weight for road markers as disclosed in the aforementioned patent, and, now, by employing the tire tread portions as an impact absorbing device.

It is to be understood that the forms of the invention herewith shown and described are to be taken as preferred examples of the same, and that various changes in the shape, size, and arrangement of parts may be resorted to, without departing from, the spirit of the invention or scope of the subjoined claims.

I claim:

1. An impact absorbing device comprising a plurality of discarded sidewall-less tire annular tread portions of various diameters, each tread portion having a continuous transversely and circumferential extending tread path, said tread portions being arranged in nested relationship, the innermost tire tread portion having the smallest diameter, each successive annular tread portion having a greater diameter than the next preceding annular tread portion, the outer peripheral surface of an annular tread portion engaging the inner peripheral surface of the adjacent annular tread portion, to thereby provide an impact unit having a plurality of coaxial annular tread portions, held in nested relationship by a friction fit.

2. An impact absorbing device according to claim 1, wherein a plurality of units are arranged in end-to-end relationship and side-by-side relationship, and fastening means extending between said units for holding said units in said relationships.

3. An impact absorbing device according to claim 2, wherein a plurality of discarded tire sidewalls are secured to one of said units.

4. An impact absorbing device according to claim 3, wherein the impact device is positioned at the end of a guard rail, one end of said impact device being connected to the end of the guard rail and the opposite end thereof being secured to the ground.

5. An impact absorbing device according to claim 3, wherein a plurality of impact devices are connected end-to-end, to thereby provide an impact absorbing retaining wall.

6. An impact absorbing device according to claim 1, wherein at least one of the impact devices is contained within a container-type abutment.

7. An impact absorbing device comprising a plurality of vertically extending, horizontally spaced stanchions supported in the ground, a horizontally extending strip of a sidewall-less discarded tire tread portion extending between and connected to adjacent stanchions on at least one side thereof, to thereby provide an impact absorbing guard rail.

8. An impact absorbing device according to claim 7, wherein a strip is connected to each side of said stanchions.

* * * * *